US011453096B1

(12) United States Patent
Burner et al.

(10) Patent No.: US 11,453,096 B1
(45) Date of Patent: Sep. 27, 2022

(54) TOOL OPERATING ASSEMBLY FOR A LENS SHAPING MACHINE

(71) Applicants: Richard L. Burner, Largo, FL (US); Alan L. Hodges, Seminole, FL (US)

(72) Inventors: Richard L. Burner, Largo, FL (US); Alan L. Hodges, Seminole, FL (US)

(73) Assignee: INTUITOS, LLC, Largo, FL (US)

( * ) Notice: Subject to any disclaimer, the term of this patent is extended or adjusted under 35 U.S.C. 154(b) by 434 days.

(21) Appl. No.: 16/873,168

(22) Filed: Feb. 19, 2020

Related U.S. Application Data

(60) Provisional application No. 62/918,946, filed on Feb. 20, 2019.

(51) Int. Cl.
*B24B 13/00* (2006.01)
*B24B 47/12* (2006.01)

(52) U.S. Cl.
CPC ..... *B24B 13/0037* (2013.01); *B24B 47/12* (2013.01)

(58) Field of Classification Search
CPC ..... B24B 13/0037; B24B 47/12
USPC ..... 318/3, 558; 451/294
See application file for complete search history.

(56) References Cited

U.S. PATENT DOCUMENTS 7,153,085 B2 * 12/2006 Clark ..... B25J 15/0616 901/30

* cited by examiner

*Primary Examiner* — David Luo
(74) *Attorney, Agent, or Firm* — Arthur W. Fisher, III

(57) ABSTRACT

A tool operating assembly for a lens shaping machine to finish the peripheral edge of a corrective lens wherein the tool operating assembly is disposed in operative relationship relative to a lens operating assembly comprising a lens support assembly to support the corrective lens to be finished and a multi-axis lens positioning assembly to move the corrective lens relative to the tool operating assembly during the finishing operation to finish the peripheral edge of the corrective lens, the tool operating assembly comprising a multi-station tool support assembly to selectively position one of a plurality of tools in operative position to engage the peripheral edge of the corrective lens to be finished and a tool drive assembly to rotate the selected tool during the finishing operation to finish the peripheral edge of the corrective lens.

16 Claims, 14 Drawing Sheets

TOOL OPERATING ASSEMBLY FOR A LENS SHAPING MACHINE

CROSS-REFERENCE

This is a nonprovisional application claiming priority of co-pending provisional application No. 62/918,946 filed Feb. 20, 2019.

BACKGROUND OF THE INVENTION

Field of the Invention

A tool operating assembly for a lens shaping machine to finish the peripheral edge of a corrective lens.

Description of the Prior Art

Numerous machines have been designed to shape and finish eye lens. Several examples of grinding or polishing machines including multiple tools are disclosed in the prior art patents referred to herein.

U.S. Pat. No. 9,527,187 describes a tool operating assembly for a lens shaping machine to finish the peripheral edge of a corrective lens wherein the tool operating assembly is disposed in operative relationship relative to a lens operating assembly comprising a lens support assembly to support the corrective lens to be finished and a multi-axis lens positioning assembly to move the corrective lens relative to the tool operating assembly during the finishing operation to finish the peripheral edge of the corrective lens comprising a multi-station tool support assembly to selectively position one of a plurality of tools in operative position to engage the peripheral edge of the corrective lens to be finished.

U.S. Pat. No. 2,485,332 shows a shoe finishing or repairing machine comprising a number of shoe finishing or repairing tools for finishing or repairing operations. The tools are selectively movable to a particular position so that less space is required for operator.

U.S. Pat. No. 2,707,855 relates to a multiple grinding machine to provide a grinder having a series of grinding wheels. The device provides a common operating means for all of the grinding wheels with control means operative to apply power only to the grinding wheel disposed at the grinding station while all of the other grinding wheels are inactive.

U.S. Pat. No. 4,481,739 shows a grinding machine comprising a pair of wheel slides disposed respectively at both sides of a work support to be movable toward and away from the work table in a first direction. The wheel slides carry turrets in such a manner that each of the turrets is rotationally indexed about and slidable along an axis thereof extending in a second direction perpendicular to the first direction. Each of the turrets carries a plurality of grinding wheels which are rotatable and when rotationally indexed selectively presents the grinding wheels to a machining station. The position of a selected one of the grinding wheels relative to a workpiece on the work support is adjusted in the first direction through the movement of each wheel slide and in the second direction through the movement of each turrets.

U.S. Pat. No. 4,922,595 discloses a turret head unit comprising a turret head in combination with a plurality of angularly disposed tool receiving spindles and a spindle drive shaft rotatably mounted in the turret head. A clutch is mounted on the spindle drive shaft and movable into and out of driving engagement with a tool receiving spindle in a working position.

Additional examples are found in the following patents: U.S. Pat. No. 2,493,206; U.S. Pat. No. 4,461,121; U.S. Pat. No. 4,617,764; U.S. Pat. No. 4,662,119; U.S. Pat. No. 4,833,764; U.S. Pat. No. 5,820,537; U.S. Pat. No. 5,951,376; U.S. Pat. No. 6,250,999; U.S. Pat. No. 6,383,061; U.S. Pat. No. 7,413,502; U.S. Pat. No. 7,422,510; U.S. Pat. No. 7,455,569; U.S. Pat. No. 7,597,033; U.S. Pat. No. 7,614,742 and U.S. Pat. No. 7,739,778.

While some of the prior art may contain some similarities relating to the present invention, none teaches as, suggest a or includes all of the advantages and unique features of the invention disclosed hereafter.

SUMMARY OF THE INVENTION

The present invention relates to a tool operating assembly for a lens shaping machine including a lens operating assembly to finish the peripheral edge or edge portion of a corrective lens similar in operation to U.S. Pat. No. 9,527,187 described hereinafter.

The lens operating assembly comprises a lens support assembly to support the corrective lens to be finished and a multi-axis lens positioning assembly to move the corrective lens supported relative to the tool operating assembly during the finishing operation.

The tool operating assembly comprises a multi-station tool support assembly to selectively position one of a plurality of tools at a finishing station or location to engage the peripheral edge or edge portion of the corrective lens to be finished, a tool drive assembly to rotate the selected tool positioned at the finishing station or location during the finishing operation and a clutch assembly to operatively couple the selected tool and the tool drive assembly to rotate the selected tool during the finishing operation.

The multi-station tool support assembly comprises a turret or turn-table having a plurality of tool assemblies rotatably mounted thereto on a drive shaft coupled to a step motor to selectively position one of the tools at the finishing position or station.

The multi-station tool support assembly further includes a turret lock to lock the turret or turn-table against rotation when in the locked position and the appropriate or selected tool and tool assembly are positioned or located at the finishing station.

A tool position sensing device is positioned or disposed adjacent each tool assembly each having a discrete identifier to cooperate with a tool assembly position sensing device disposed adjacent the finishing station to indicate the rotational position of the turret or turn-table and the tool assemblies relative to the finishing station to assure the selected tool is positioned or located at the finishing station or a single sensing device and a discrete identifier to locate station 1 using an encoder to determine locations of other stations.

The invention accordingly comprises the features of construction, combination of elements, and arrangement of parts which will be exemplified in the construction hereinafter set forth, and the scope of the invention will be indicated in the claims.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
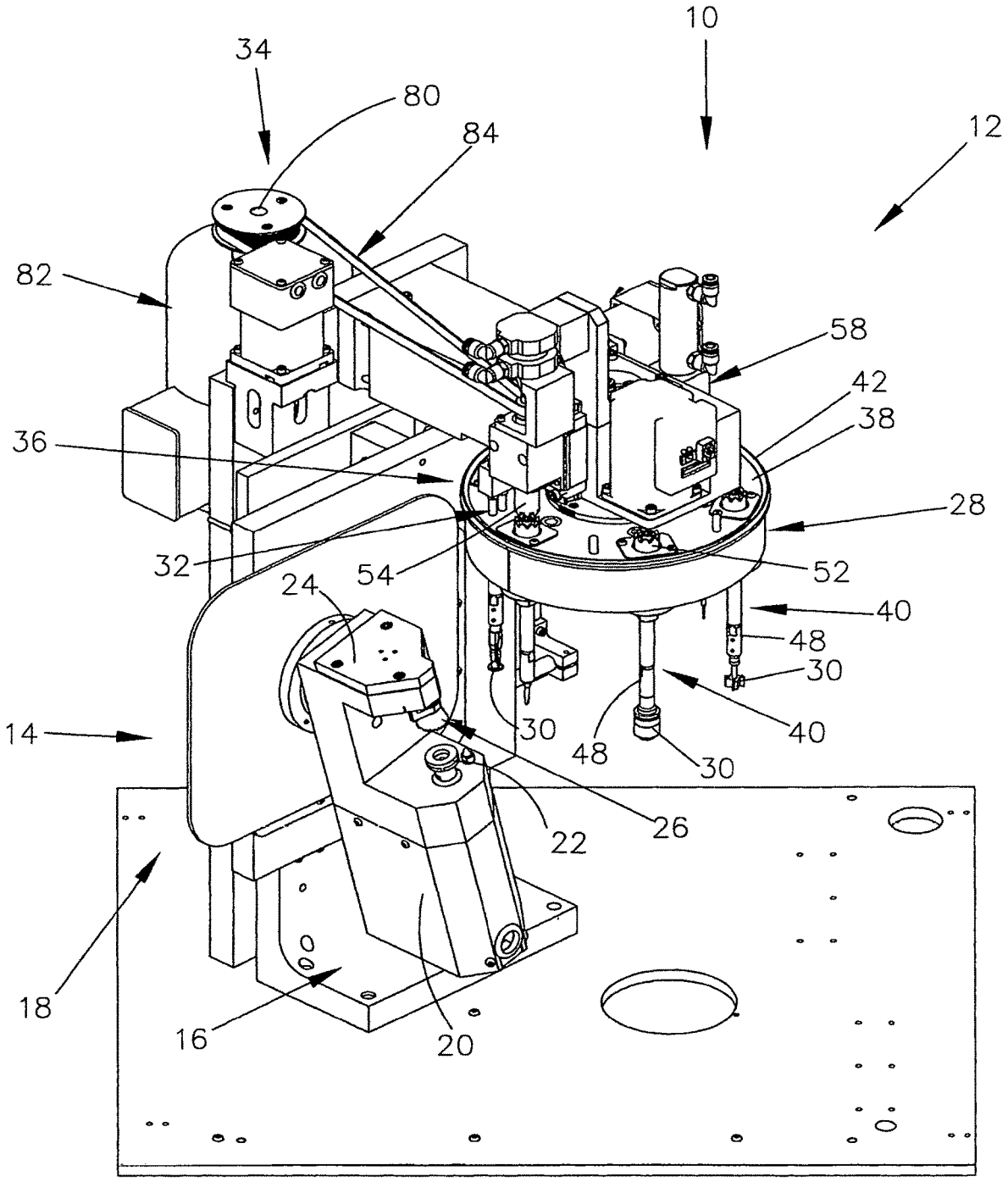
FIG. 1 is a front perspective view of the tool operating assembly and lens operating assembly of U.S. Pat. No. 9,527,187.
Figure 2:
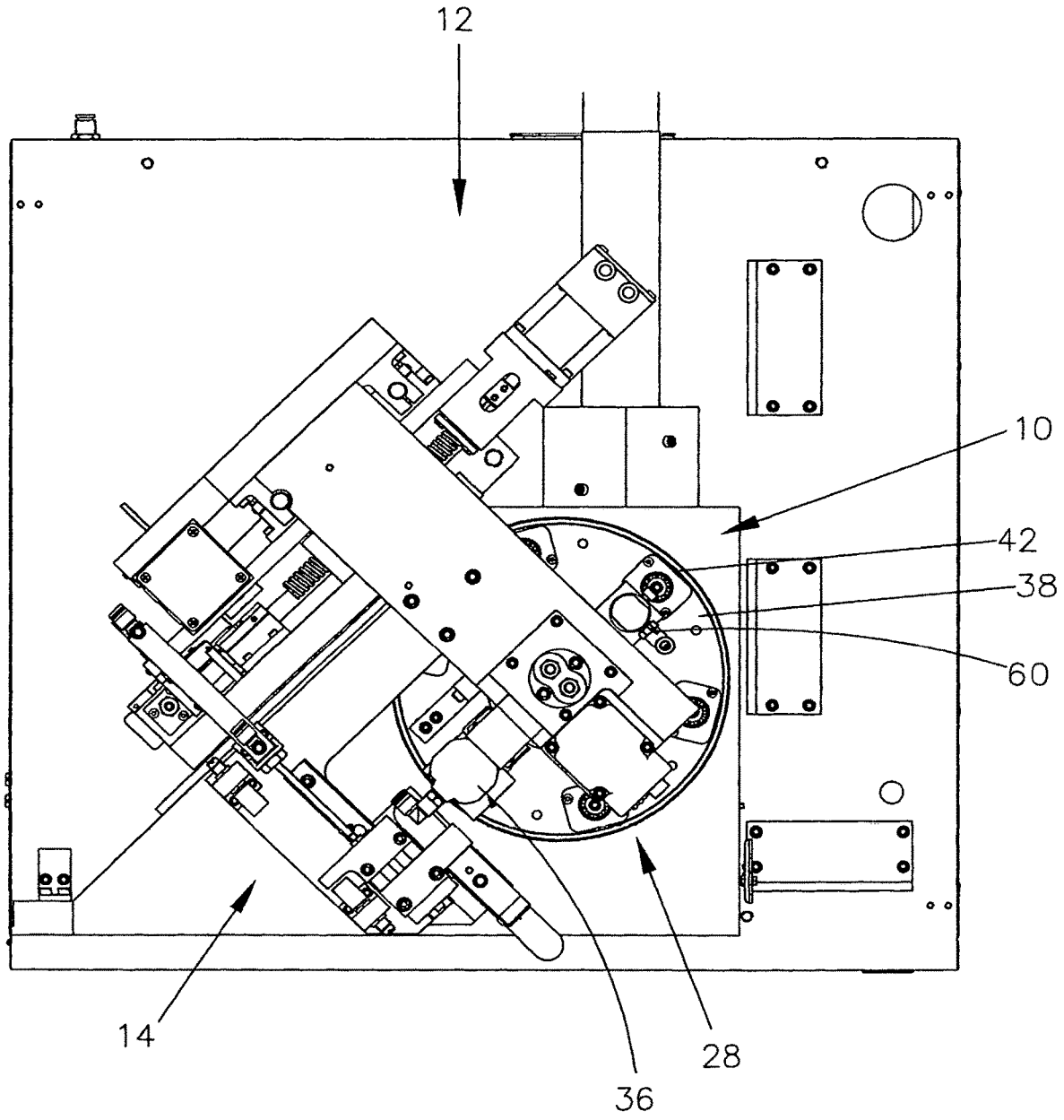
FIG. 2 is a top view of the tool operating assembly and lens operating assembly of U.S. Pat. No. 9,527,187.
Figure 3:
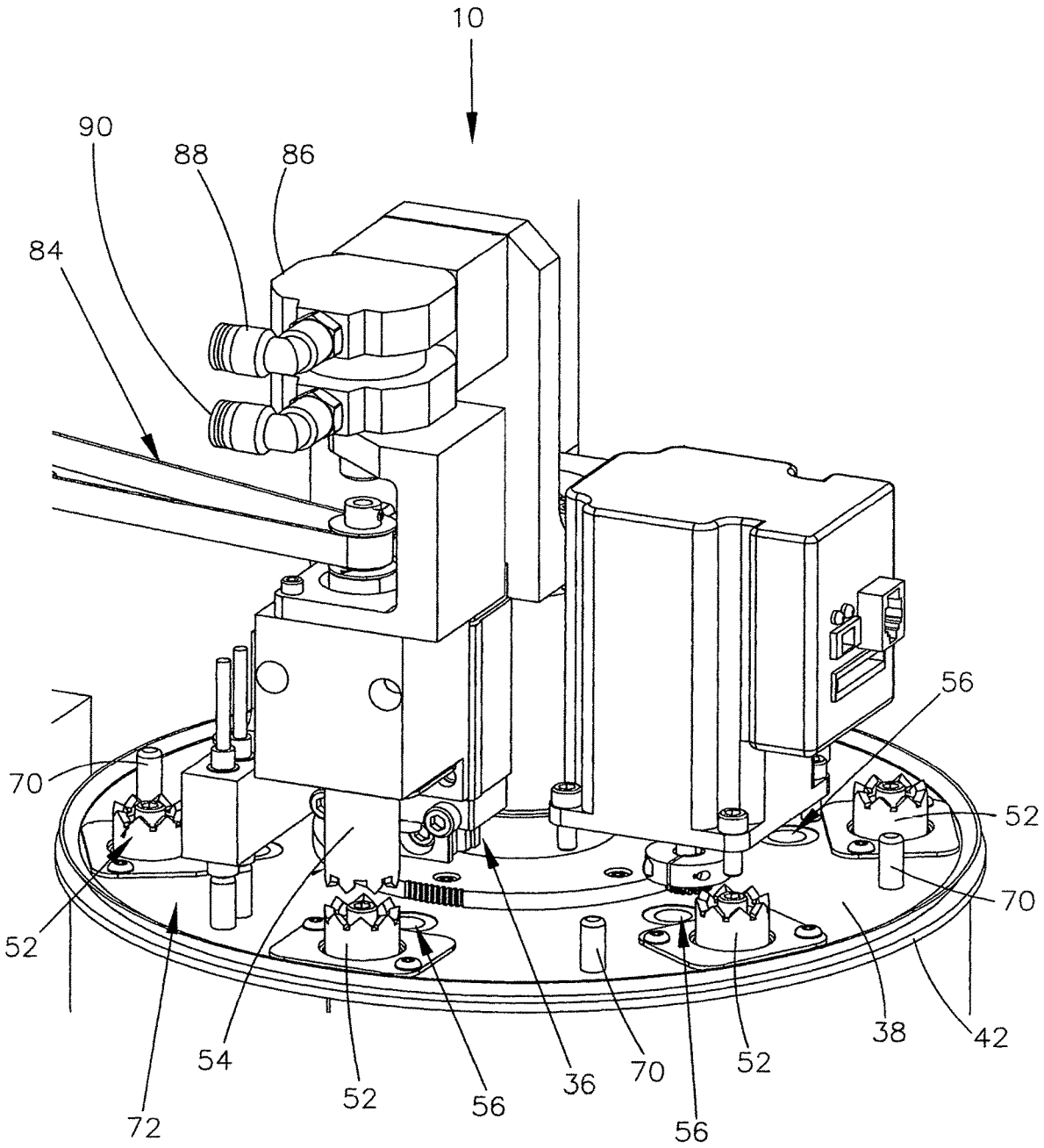
FIG. 3 is a front perspective view of the tool operating assembly of U.S. Pat. No. 9,527,187.
Figure 4:
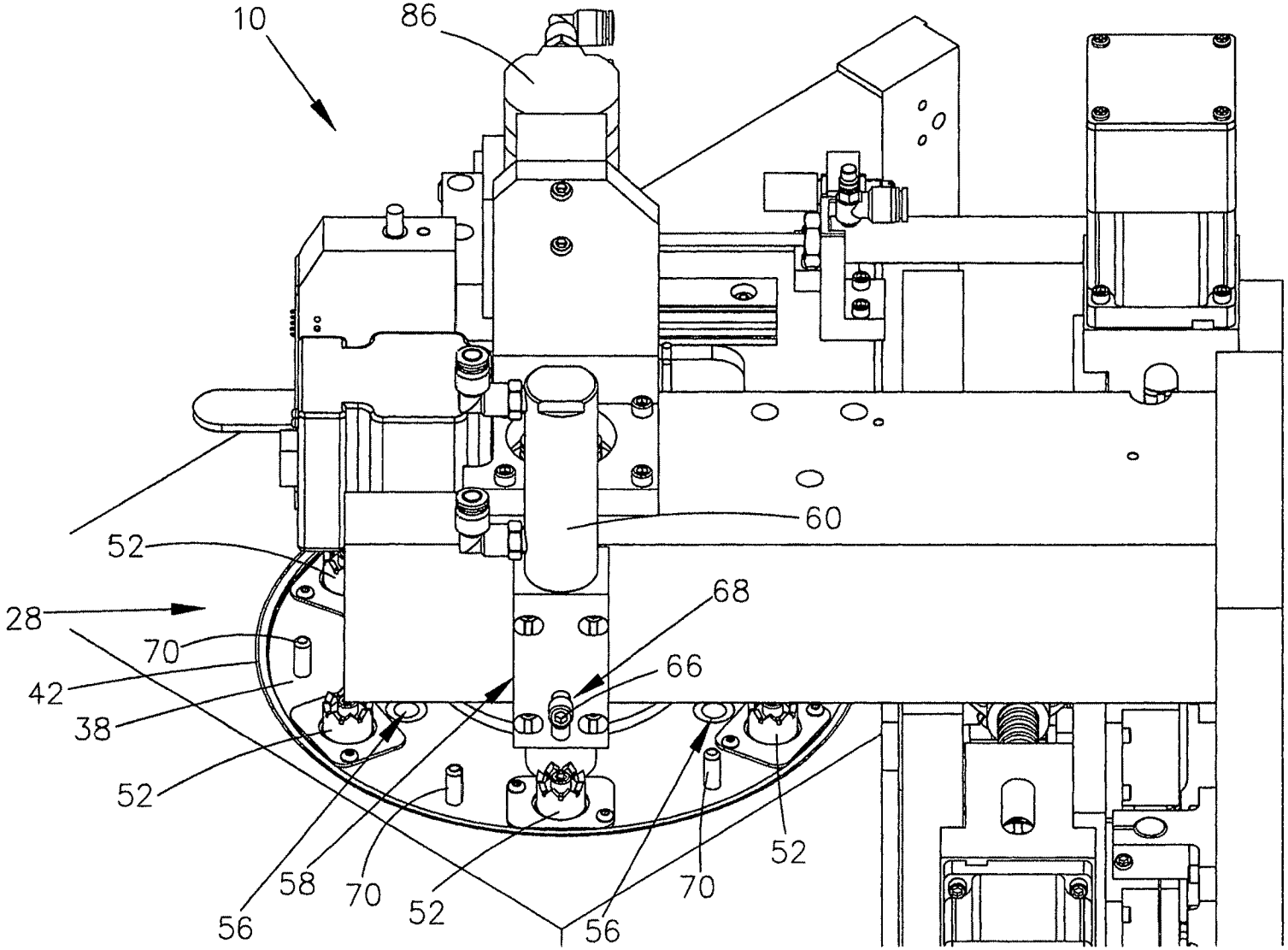
FIG. 4 is a side perspective view of the tool operating assembly of U.S. Pat. No. 9,527,187.

As shown in FIGS. 1 and 2, the earlier invention of U.S. Pat. No. 9,527,187 relates to a tool operating assembly generally indicated as 10 for a lens shaping machine generally indicated as 12 including a lens operating assembly generally indicated as 14 to finish the peripheral edge or edge portion of a corrective lens (not shown) disposed in operative relationship relative to the tool operating assembly 10 within a sealed edging or finishing chamber of a cabinet (not shown). The lens shaping machine 12 is capable of forming straight and angle lens edges such as rimless, grooved, square bevel, 'V' bevel, step bevel, facet and polished as well as straight and angled hole/slot configurations such as blind hole, through hole, slot, notch, countersunk or engraving of lens top surface.

As best shown in FIG. 1, the lens operating assembly 14 comprises a lens support assembly generally indicated as 16 to support the corrective lens (not shown) to be finished and a multi-axis lens positioning assembly generally indicated as 18 to move the corrective lens (not shown) supported on the lens support assembly 16 relative to the tool operating assembly 10 during the finishing operation.

As best shown in FIG. 1, the lens support assembly 16 comprises a lower lens support 20 including a lower lens holder 22 and an upper lens support 24 including an upper lens holder 26 to clamp the corrective lens (not shown) therebetween during the finishing operation.

As shown in FIG. 1, the multi-axis lens positioning assembly 18 comprises a first or vertical positioning subassembly, a second or horizontal positioning subassembly and a third or rotational positioning subassembly to move the lens support assembly 16 and corrective lens (not shown) vertically, horizontally and rotationally respectively relative to the tool operating assembly 10 during the finishing operation as depicted by the directional arrows.

As shown in FIGS. 1 through 5, the tool operating assembly 10 comprises a multi-station tool support assembly generally indicated as 28 to selectively position one of a plurality of tools each indicated as 30 at a finishing station or location generally indicated as 32 adjacent the lens operating assembly 14 to engage the peripheral edge or edge portion of the corrective lens (not shown) to be finished, a tool drive assembly generally indicated as 34 to rotate the selected tool 20 positioned at the finishing station or location 32 during the finishing operation and a clutch assembly generally indicated as 36 to operatively couple the selected tool 30 and the tool drive assembly 34 to rotate the selected tool 30 during the finishing operation.

Figure 5:
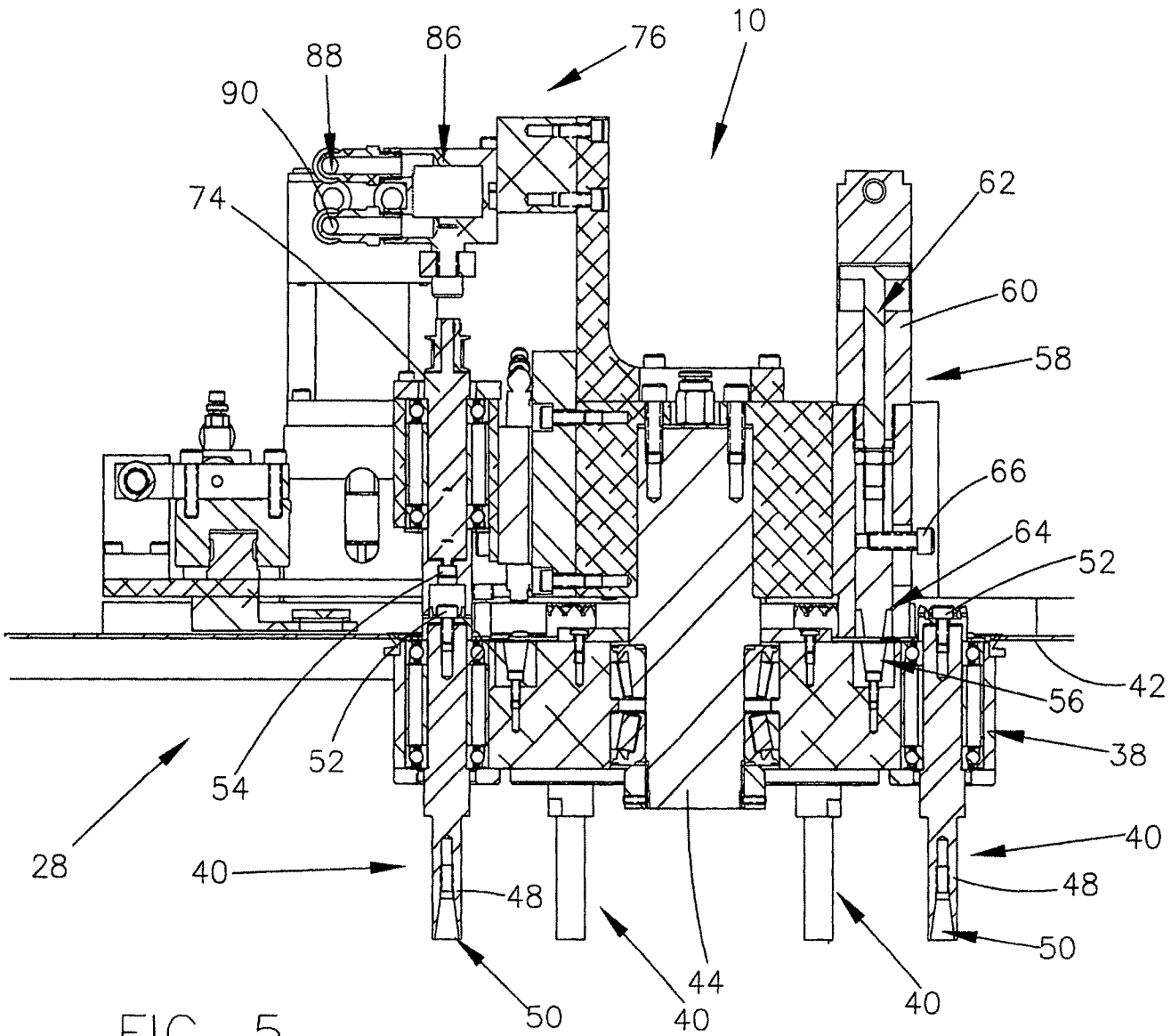
FIG. 5 is a cross-sectional side view of the tool operating assembly of U.S. Pat. No. 9,527,187.

As shown in FIG. 5, the multi-station tool support assembly 28 comprises a turret or turn-table 38 having a plurality of tool assemblies each generally indicated as 40 rotatably mounted thereto within a substantially circular shroud or apron 42 on a substantially vertical drive shaft 44 coupled to a step motor (not shown) to selectively position one of the tools 30 at the finishing position or station 32.

As shown in FIG. 5, each tool assembly 40 comprises a tool holder 48 including a tool recess 50 formed in the lower portion thereof to couple a tool 30 thereto and a lower drive or clutch element 52 such as a serrated or notched crown extending above the turret or turn-table 38 affixed to the upper portion of the corresponding tool holder 48 to engage a similarly configured upper drive or clutch element 54 when the selected tool assembly 40 is located or positioned at the finishing station 32 to cooperatively form a portion of the clutch assembly 36 to rotate the selected tool 30 to finish the peripheral edge or edge portion of the corrective lens (not shown).

The multi-station tool support assembly 28 further includes a turret lock corresponding to each tool assembly 40. Specifically, a lock receiver 56 such as a tapered recess is formed in the turret or turn-table 38 adjacent each tool assembly 40 to cooperate with a turret or turn-table locking assembly generally indicated as 58 operable in a locked position and an unlocked position to lock the turret or turn-table 38 against rotation when in the locked position and the appropriate or selected tool 30 and tool assembly 40 are positioned or located at the finishing station 32. The turret or turn-table locking assembly 58 comprises a lock cylinder 60 and a lock piston 62 combination coupled to a pressurized air source (not shown) to selectively move the piston 62 up and down to move a tapered locking pin 64 into the appropriate lock receiver 56 opposite the finishing station 32 when the appropriate tool 30, tool assembly 40 and lower clutch element 52 are aligned with the finishing station 32 when the locked or down position. The turret or turn-table locking assembly 58 further includes a manual positioning device comprising a finger knob 66 extending through a substantially vertical slot 68 attached to or engaged with the lock piston 62.

In addition, a tool position sensing device 70 is positioned or disposed adjacent each tool assembly 40 each having a discrete identifier to cooperate with a tool assembly position sensing device 72 disposed adjacent the finishing station 32 to indicate the rotational position of the turret or turn-table 38 and the tool assemblies 40 relative to the finishing station 32 to assure the proper tool 30 is positioned or located at the finishing station 32.

Alternatively, a single sensing device and a discrete identifier to locate station1 using an encoder to determine locations of other stations.

As shown in FIGS. 1 and 5, the tool drive assembly 34 comprises a substantially vertical tool drive shaft 74 disposed in vertical alignment relative to the finishing station 32 having the upper drive or clutch element 54 coupled to the lower position thereof and movable between an upper position and a lower position by a clutch positioning device 76 such that the serrated or notched crown or upper drive or clutch element 54 engages the serrated or notched crown of the lower drive or clutch element 52 of the tool assembly 40 located or positioned at the finishing station 32 when the substantially vertical tool drive shaft 74 is in the lower position. The substantially vertical tool drive shaft 74 is coupled to the output shaft 80 of a tool drive motor generally indicated as 82 by a drive linkage generally indicated as 84 such as a drive belt.

The clutch positioning device 76 comprises a pneumatic clutch cylinder 86 to operatively house a piston (not shown) coupled to the substantially vertical tool drive shaft 74 to move the tool drive shaft 74 and the serrated or notched crown or upper drive or clutch element 54 into and out of operative engagement with the serrated or notched crown of the lower drive or clutch element 52 by feeding air to one side or the other of the piston (not shown) through air ports 88 and 90 to selectively drive the tool 26 of the tool assembly 40 located at the finishing station 32.

Since the turret or turn-table 38 is driven or rotated by a step motor (not shown), the turret or turn-table 38 is incrementally advanced from one tool assembly 40 to the next tool assembly 40 until the correct tool 30 is sensed by the tool sensing device 70 and tool assembly position sensing device 72 as positioned or located at the finishing station 32 aligning the lower drive or clutch element 52 and upper drive or clutch element 54.

Alternatively, the position of the tool assemblies 40 relative to the finishing station 32 may be determined using a single device and discrete identifier to locate a specific designated tool assembly 40 using an encoder to determine the location of the other tool assemblies 40.

The turret or turn-table 38 is then locked in place the turret or turn-table locking assembly 58. Finally, the clutch assembly is engaged and the tool drive motor 82 and the drive linkage 84 rotate the tool drive shaft 74 to rotate the selected tool assembly 40 and tool 30.

The following discussion describes two additional embodiments that relate to enhancements of the tool operating assembly for a lens shaping machine disclosed in U.S. Pat. No. 9,527,187.

The first embodiment includes magnetically coupled disks that are non-contact, high-speed clutches. These clutches selectively drive multiple cutting tool spindles with a single electric motor reducing manufacturing costs, maintenance and spare parts inventory.

These magnetic couplings allow the transmission of revolutions as high as 42,000 rpm without precisely machined components. In addition, there are no moving parts in contact, eliminating clutch wear, maintenance and failure.

Since there is no structure, only air between the disks, the spacing or gap between the disks is reduced; allowing the disks to transmit greater torque; i.e., torque capacity is an exponential function of the air gap distance.

For example, an air gap of 1.5 mm can produce a torque of 0.24 Nm.

In a second assembly, an air gap of 2 mm can provide a torque of 1.2 Nm.

Though these torque values appear small, the torque can transmit 0.6 horse power at 17,200 revolutions per minute up to , 3.0 horse power at 18,000 revolutions per minute.

As more fully described hereinafter, the instant invention comprises a rotatable turret with multiple spindles spaced evenly about a common center. Each spindle holds a different drilling, milling, grinding or polishing tool. The turret is rotated by a step motor aligning the desired spindle with the clutch. The selected spindle once positioned is then locked in place by a conical pin actuated by a pneumatic cylinder.

Each of the driven tools requires a different rotational speed for most efficient cutting. A motor with a nominal speed of 3,600 revolutions per minute may be used. The cutters, however, require speeds between 8,000 and 27,000 revolutions per minute. A 5:1 timing belt drive serves to increase the nominal clutch revolutions per minute to 18,000. A variable frequency drive adjusts the motor speed to match the requirements of the currently selected cutter. The variable frequency drive can vary the motor speed between 0 and 72,000 variable frequency drive (0 to 36,000 revolutions per minute at the clutch).

The second embodiment relates to the driving clutch disk directly coupled to the spindle drive motor. For each cutting tool station, the turret has two timing belt pulleys. One is on the same shaft as the driven magnetic clutch disk. The other is co-axial with the cutting tool spindle. A short belt connects the two.

The direct drive uses a high-speed, DC motor. Depending in the grinding tools, the rotational speed may vary 11000 rpm to 17200 revolutions per minute.

The rotational speed is controlled by physically interchanging pulley sets on a spindle-by-spindle basis. Each spindle uses two pulleys which, combined, have a total tooth count of 36. This allows every spindle to use the same length of timing belt.

For example, both the driving shaft and driven shaft are designed and configured for pulleys with 14 to 22 teeth. This provides the following spindle speeds with the current motor to be used.

| . Pulley Combinations | | | Spindle |
|---|---|---|---|
| Driving | Driven | Ratio | rpm |
| 14 | 22 | 0.636 | 10945 |
| 15 | 21 | 0.714 | 12286 |
| 16 | 20 | 0.800 | 13760 |
| 17 | 19 | 0.895 | 15389 |
| 18 | 18 | 1.000 | 17200 |
| 19 | 17 | 1.118 | 19224 |
| 20 | 16 | 1.250 | 21500 |
| 21 | 15 | 1.400 | 24080 |
| 22 | 14 | 1.571 | 27029 |

As shown in FIGS. 6 through 10, the first embodiment of the present invention comprises a tool operating assembly generally indicated as 10 for a lens shaping machine generally indicated as 12 including a lens operating assembly generally indicated as 14 to finish the peripheral edge or edge portion of a corrective lens (not shown) disposed in operative relationship relative to the tool operating assembly 10 within a sealed edging or finishing chamber of a cabinet (not shown). The lens shaping machine 12 is capable of forming straight and angle lens edges such as rimless, grooved, square bevel, 'V' bevel, step bevel, facet and polished as well as straight and angled hole/slot configurations such as blind hole, through hole, slot, notch, countersunk or engraving of lens top surface.

Figure 6:
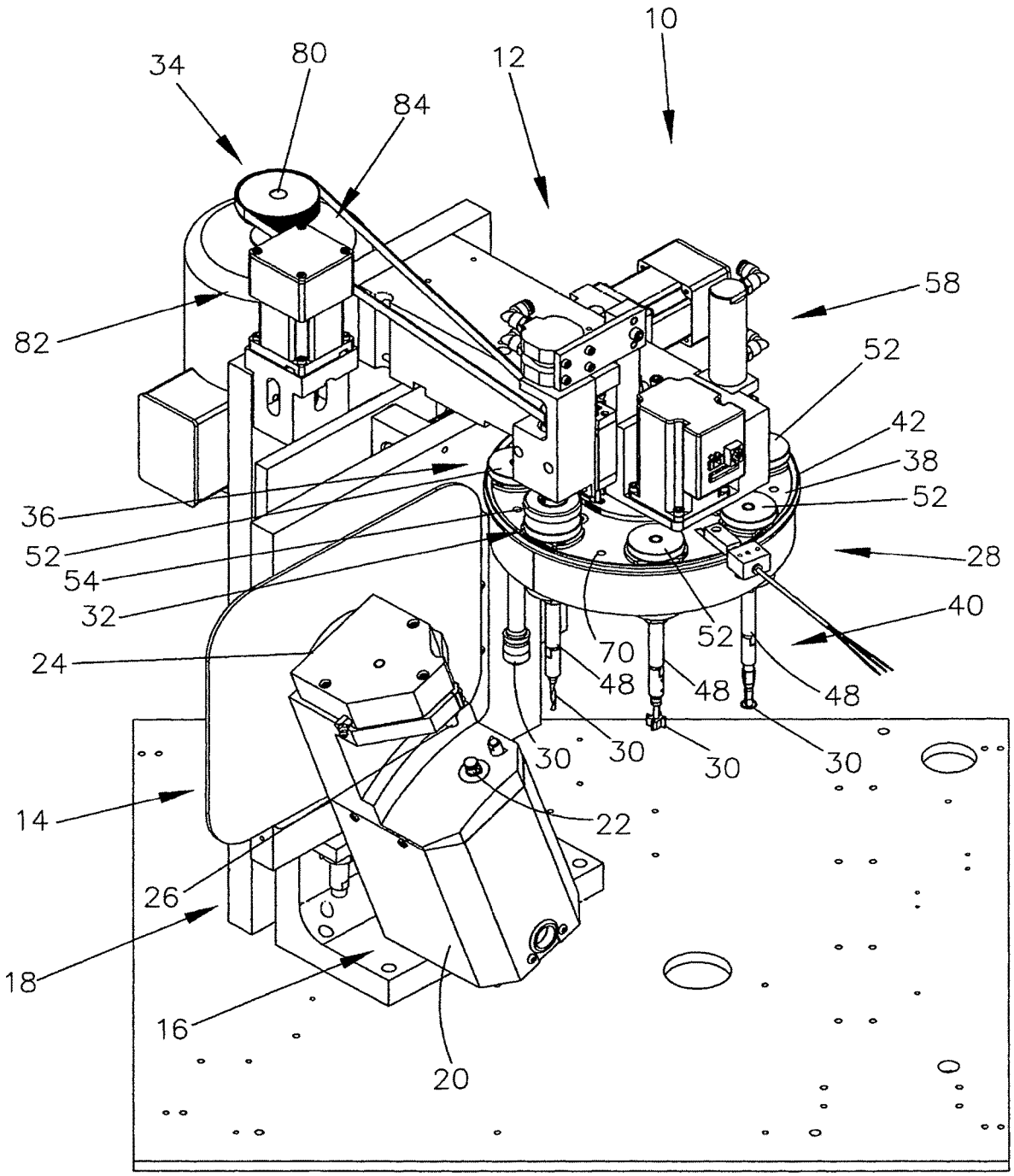
FIG. 6 is a front perspective view of the tool operating assembly and lens operating assembly of the present invention.
Figure 7:
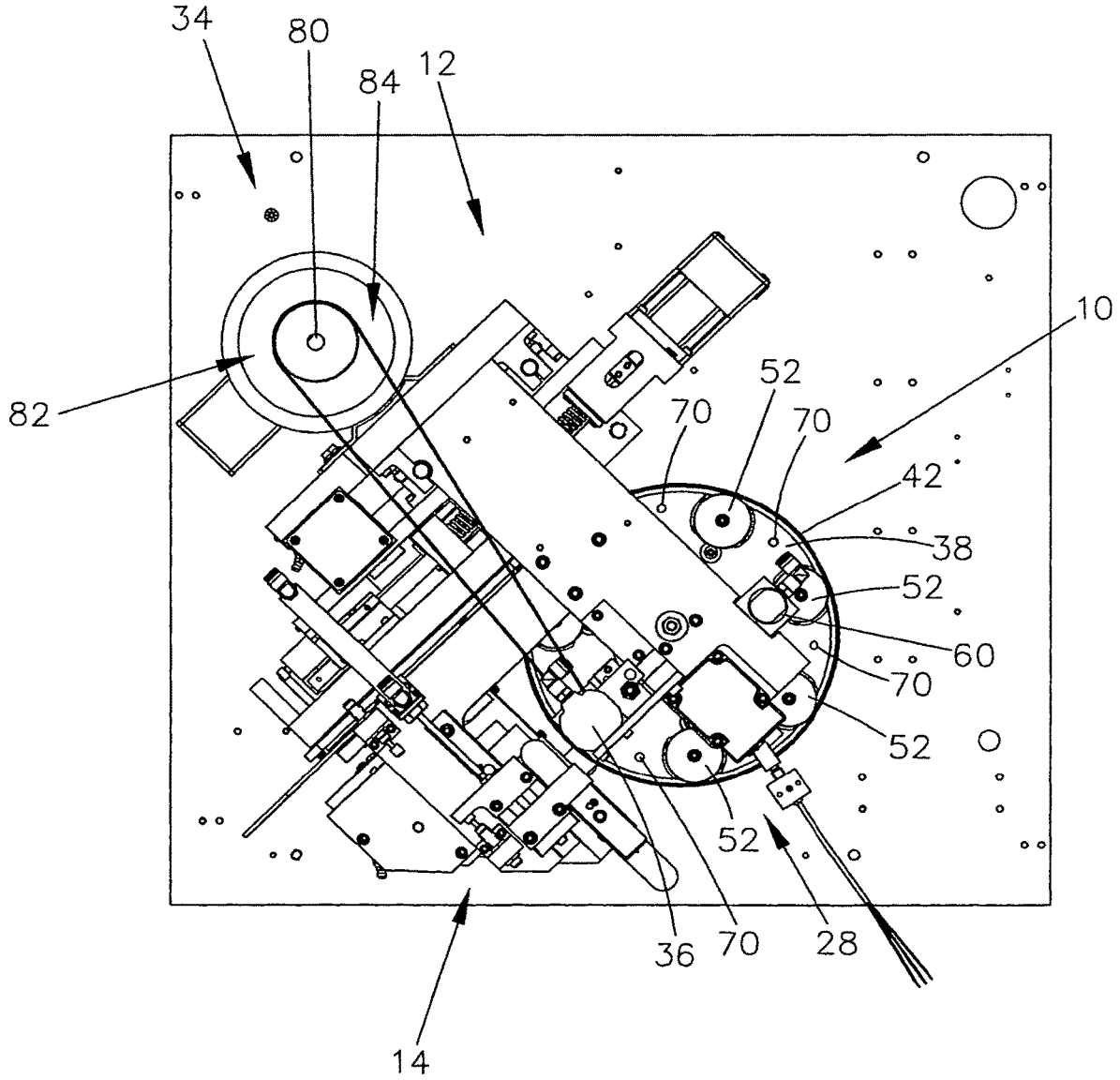
FIG. 7 is a top view of the tool operating assembly and lens operating assembly of the present invention.
Figure 8:
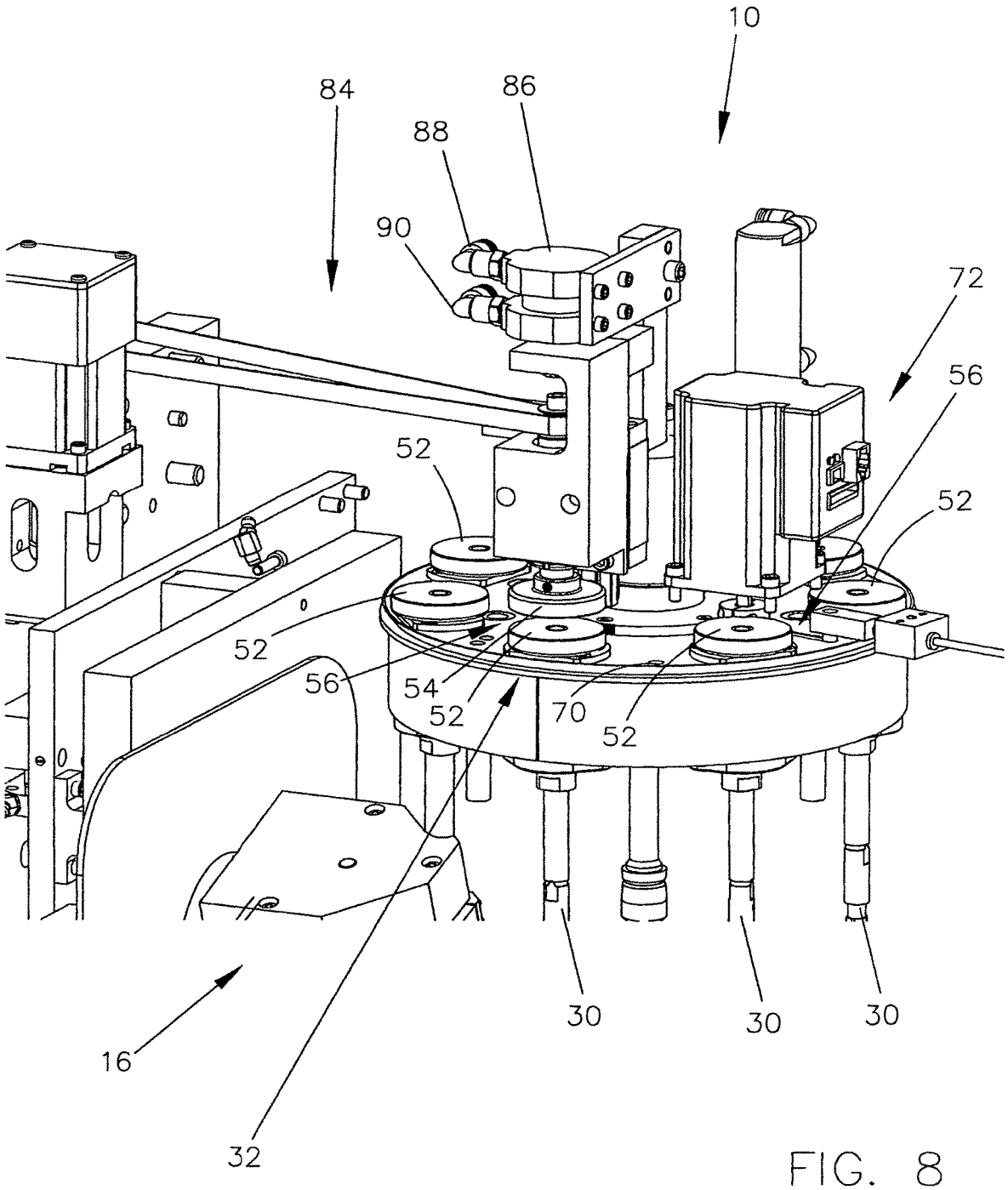
FIG. 8 is a front perspective view of the tool operating assembly of the present invention.
Figure 9:
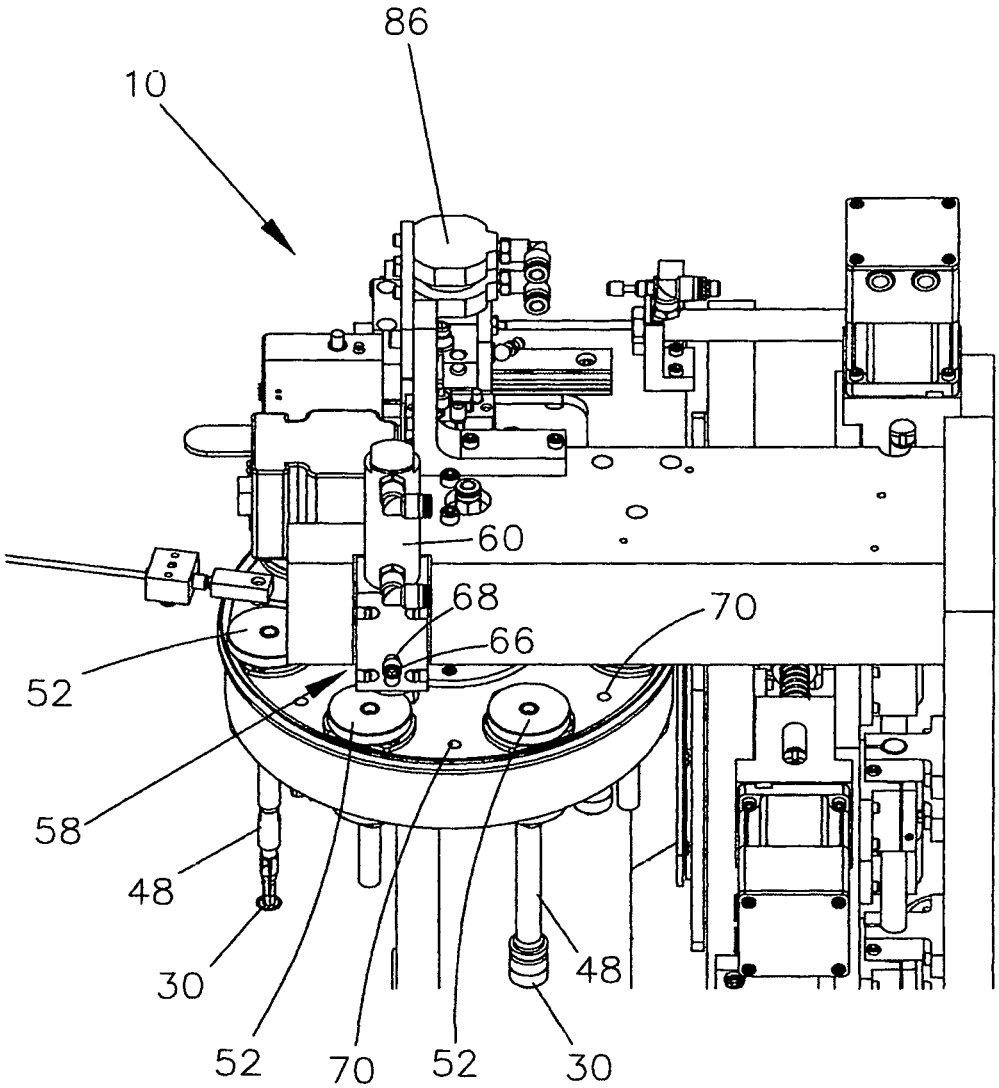
FIG. 9 is a side perspective view of the tool operating assembly of the present invention.
Figure 10:
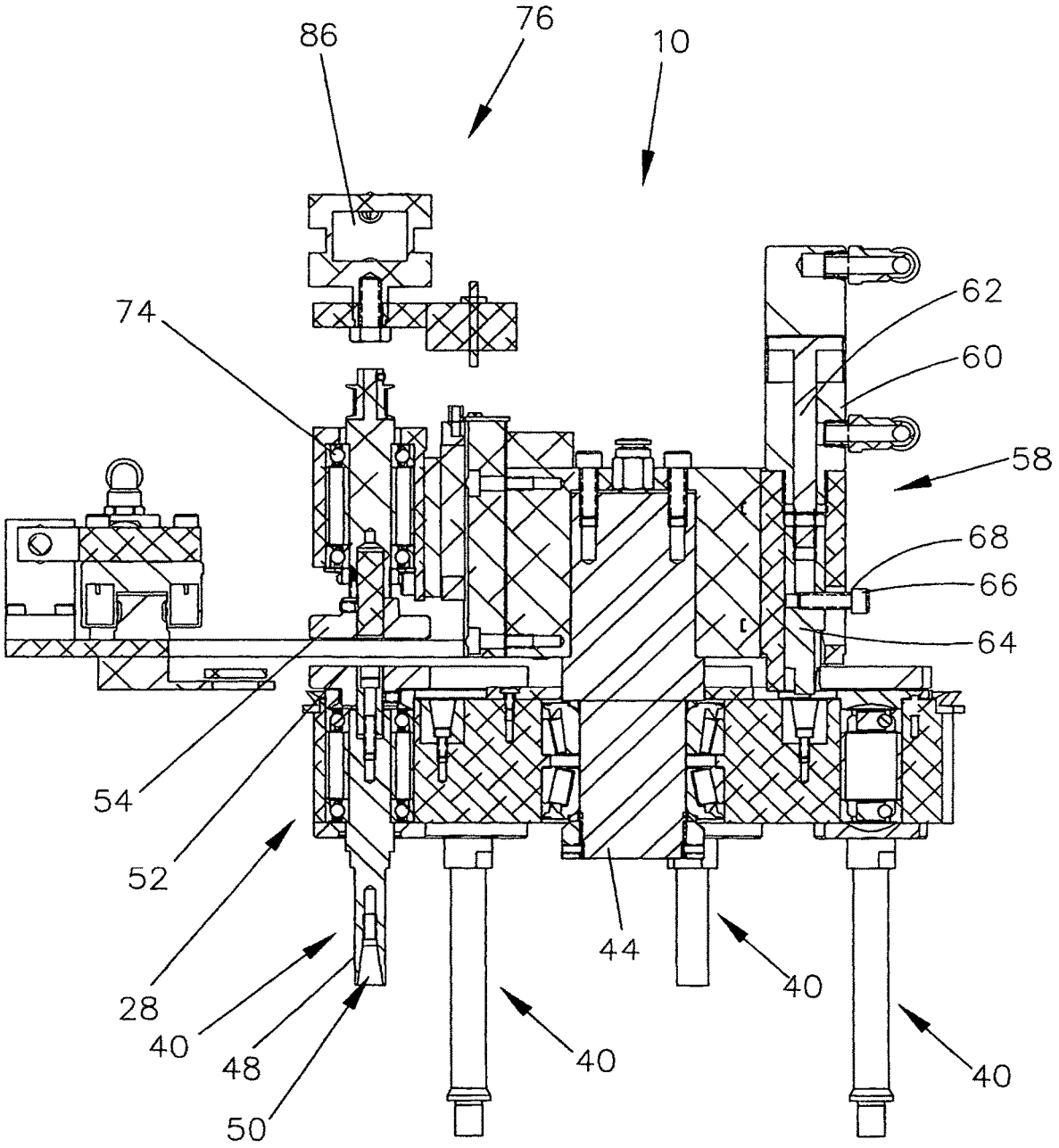
FIG. 10 is a cross-sectional side view of the tool operating assembly of the present invention.
Figure 11:
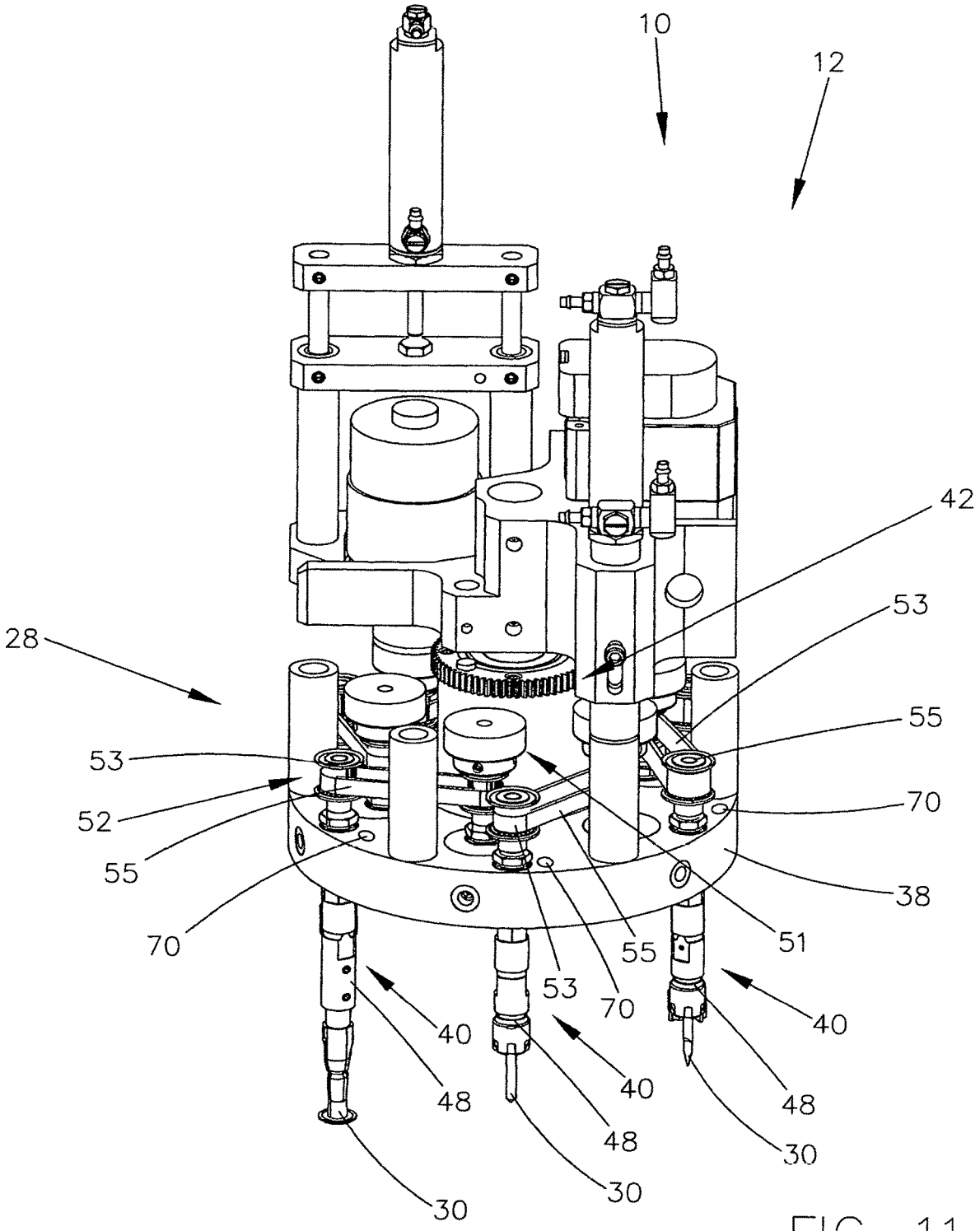
FIG. 11 is a top perspective view of the tool operating assembly of an alternate embodiment of the present invention.
Figure 12:
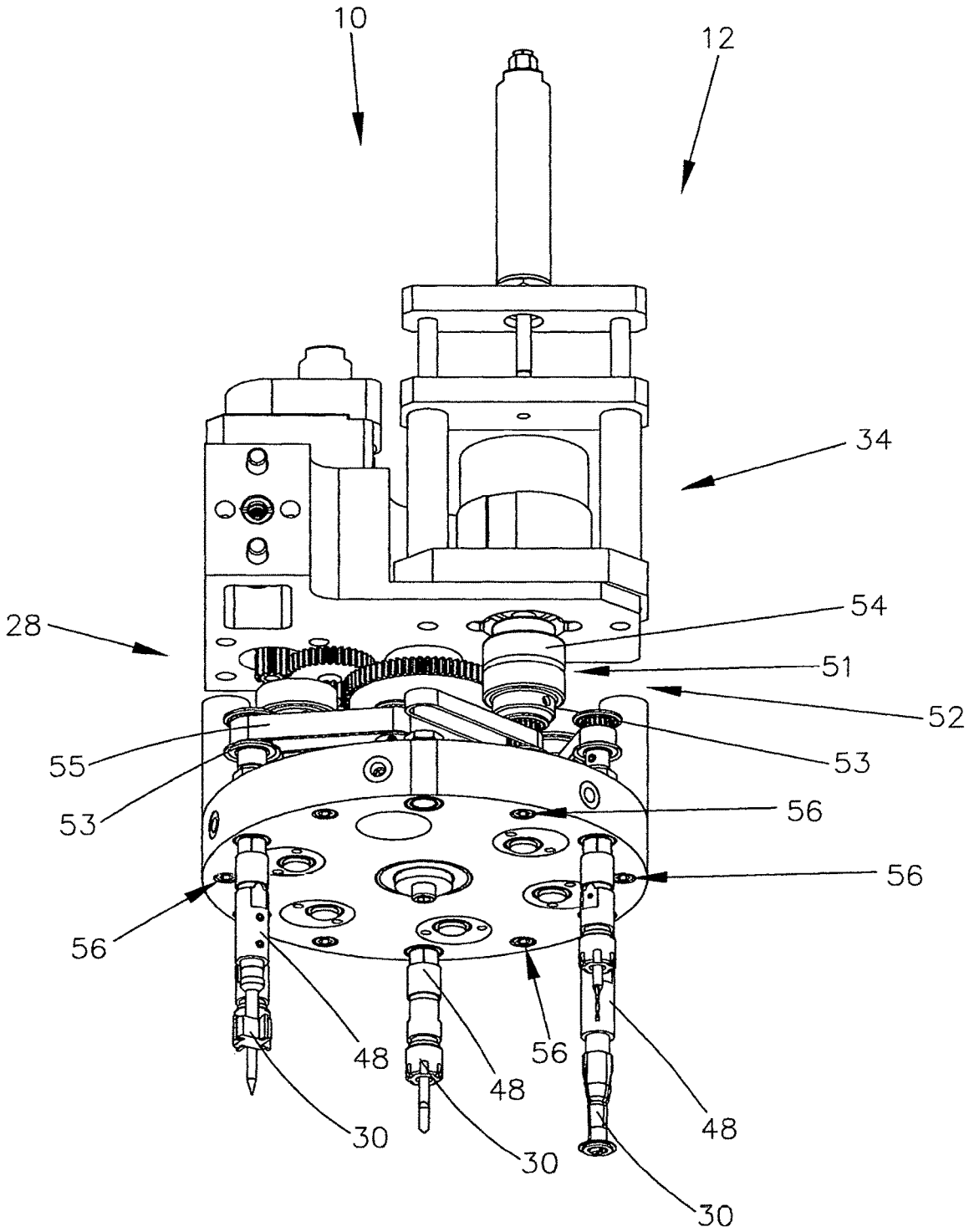
FIG. 12 is a bottom perspective view of the tool operating assembly of the alternate embodiment of the present invention.
Figure 13:
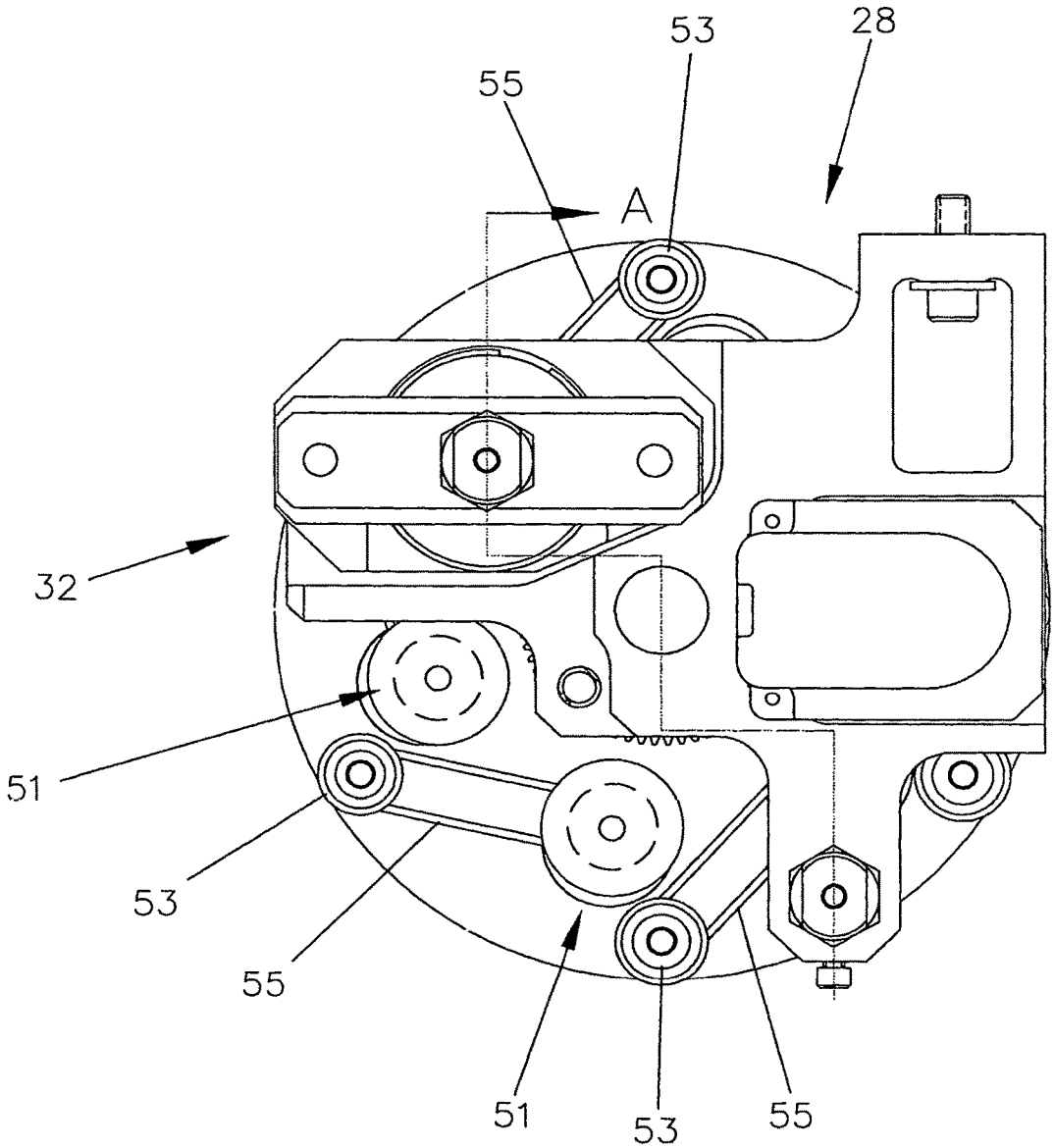
FIG. 13 is a top view of the tool operating assembly of the alternate embodiment of the present invention.
Figure 14:
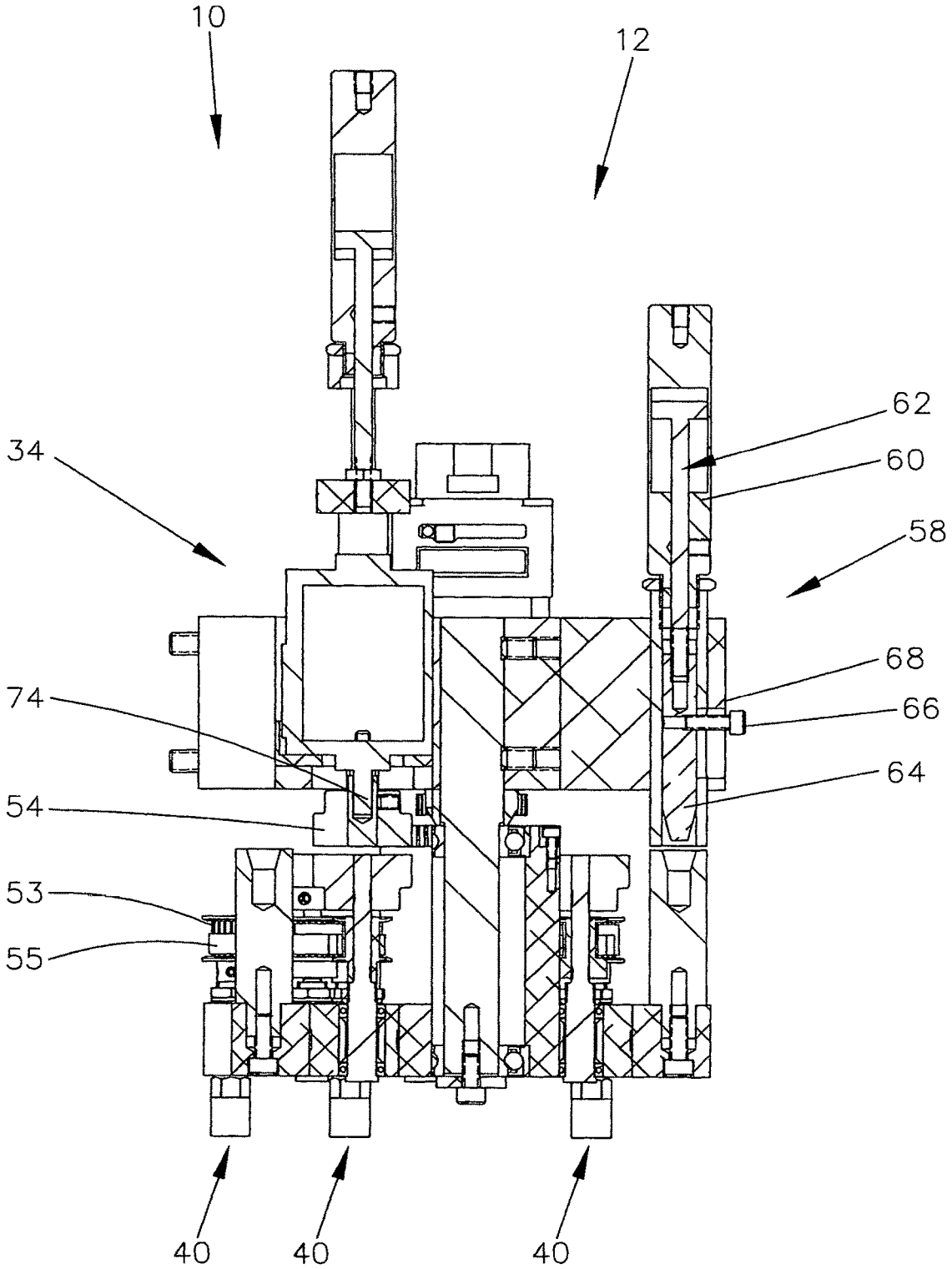
FIG. 14 is a cross-sectional side view of the tool operating assembly of the alternate embodiment of the present invention.

As best shown in FIG. 6, the lens operating assembly 14 comprises a lens support assembly generally indicated as 16 to support the corrective lens (not shown) to be finished and a multi-axis lens positioning assembly generally indicated as 18 to move the corrective lens (not shown) supported on the lens support assembly 16 relative to the tool operating assembly 10 during the finishing operation.

As best shown in FIG. 6, the lens support assembly 16 comprises a lower lens support 20 including a lower lens holder 22 and an upper lens support 24 including an upper lens holder 26 to clamp the corrective lens (not shown) therebetween during the finishing operation.

As shown in FIG. 6, the multi-axis lens positioning assembly 18 comprises a first or vertical positioning subassembly, a second or horizontal positioning subassembly and a third or rotational positioning subassembly to move the lens support assembly 16 and corrective lens (not shown) vertically, horizontally and rotationally respectively relative to the tool operating assembly 10 during the finishing operation.

As shown in FIG. 6, the tool operating assembly 10 comprises a multi-station tool support assembly generally indicated as 28 to selectively position one of a plurality of tools each indicated as 30 at a finishing station or location generally indicated as 32 adjacent the lens operating assembly 14 to engage the peripheral edge or edge portion of the corrective lens (not shown) to be finished, a tool drive assembly generally indicated as 34 to rotate the selected tool 30 positioned at the finishing station or location 32 during the finishing operation and a clutch assembly generally indicated as 36 to operatively couple the selected tool 30 and the tool drive assembly 34 to rotate the selected tool 30 during the finishing operation.

The multi-station tool support assembly 28 comprises a turret or turn-table 38 having a plurality of tool assemblies each generally indicated as 40 rotatably mounted thereto within a substantially circular shroud or apron 42 on a substantially vertical drive shaft 44 coupled to a step motor (not shown) to selectively position one of the tools 30 at the finishing position or station 32.

Each tool assembly 40 comprises a tool holder 48 including a tool recess 50 (FIG. 10) formed in the lower portion thereof to couple a tool 30 thereto and a lower magnetic drive or clutch element 52 such as a rotatable magnetic disk extending above the turret or turn-table 38 affixed to the upper portion of the corresponding tool holder 48 and an upper drive or clutch element 54 comprising a magnetic disk located or positioned at the finishing station 32 to cooperatively form the magnetically coupled clutch assembly 36 to rotate the selected tool 30 located at the finishing station 32 to finish the peripheral edge or edge portion of the corrective lens (not shown).

The multi-station tool support assembly 28 further includes a turret lock corresponding to each tool assembly 40. Specifically, a lock receiver 56 such as a tapered recess is formed in the turret or turn-table 38 adjacent each tool assembly 40 to cooperate with a turret or turn-table locking assembly generally indicated as 58 operable in a locked position and an unlocked position to lock the turret or turn-table 38 against rotation when in the locked position and the appropriate or selected tool 30 and tool assembly 40 are positioned or located at the finishing station 32. The turret or turn-table locking assembly 58 comprises a lock cylinder 60 and a lock piston 62 combination coupled to a pressurized air source (not shown) to selectively move the piston 62 up and down to move a tapered locking pin 64 into the appropriate lock receiver 56 opposite the finishing station 32 when the appropriate tool 30, tool assembly 40 and lower clutch element 52 are aligned with the finishing station 32 when the locked or down position. The turret or turn-table locking assembly 58 further includes a manual positioning device comprising a finger knob 66 extending through a substantially vertical slot 68 attached to or engaged with the lock piston 62.

In addition, a tool position sensing device 70 is positioned or disposed adjacent each tool assembly 40 each having a discrete identifier to cooperate with a tool assembly position sensing device 72 to indicate the rotational position of the turret or turn-table 38 and the tool assemblies 40 relative to the finishing station 32 to assure the selected tool 30 is positioned or located at the finishing station 32.

Alternatively, the position of the tool assemblies 40 relative to the finishing station 32 may be determined using a single device and discrete identifier to locate a specific designated tool assembly 40 using an encoder to determine the location of the other tool assemblies 40.

The tool drive assembly 34 comprises a substantially vertical tool drive shaft 74 disposed in vertical alignment relative to the finishing station 32 having the upper magnetic drive or clutch element 54 coupled to the lower portion thereof and movable between an upper position and a lower position by a clutch positioning device 76. When the upper magnetic drive or clutch element 54 is moved to the lower position by the substantially vertical tool drive shaft 74 forming the air gap with the lower metal drive or clutch element 52 located at the finishing station 32 in the lower position, the upper magnetic drive or clutch element 54 and the lower drive or clutch element 52 are magnetically coupled. In turn, the substantially vertical tool drive shaft 74 forming the is coupled to the output shaft 80 of a tool drive motor generally indicated as 82 by a drive linkage generally indicated as 84 such as a drive belt.

The clutch positioning device 76 comprises a pneumatic clutch cylinder 86 to operatively house a piston (not shown) coupled to the substantially vertical tool drive shaft 74 to move the tool drive shaft 74 and the upper magnetic drive or clutch element 54 into and out of operative magnetic coupling with the lower magnetic drive or clutch element 52 by feeding air to one side or the other of the piston (not shown) through air ports 88 and 90 to selectively drive the tool 26 of the tool assembly 40 located at the finishing station 32.

Since the turret or turn-table 38 is driven or rotated by a step motor (not shown), the turret or turn-table 38 is incrementally advanced from one tool assembly 40 to the next tool assembly 40 until the correct or selected tool assembly 40 and tool 30 are sensed by the tool sensing device 70 and tool assembly position sensing device 72 positioned or located at the finishing station 32 aligning the lower magnetic drive or clutch element 52 and upper drive or clutch element 54. The turret or turn-table 38 is then locked in place the turret or turn-table locking assembly 58. Finally, the clutch assembly is magnetically coupled and the tool drive motor 82 and the drive linkage 84 rotate the tool drive shaft 74 to rotate the selected tool assembly 40 and tool 30.

The tool drive motor 82 may be a variable speed motor such that the various tool assemblies 40 and tools 30 may be selectively driven or rotated at different speeds depending on the specific tool assembly 40 aligned and sensed at the finish station 32.

FIGS. 11 through 14 disclose an alternate embodiment of tool operating assembly generally indicated as 10 essentially the same structure and function as the first embodiment of this invention shown in FIGS. 6 through 10 except for the magnetic coupled clutch assembly 36. For each tool assembly 40, the turret or turn-table 38 has two timing belt pulleys. One pulley 51 is on the same shaft as the magnetic driving clutch disk 51. The other pulley 53 is co-axial with the cutting tool 30. A timing drive belt 55 connects the two pulleys for lens shaping.

The lens shaping machine 12 includes a lens operating assembly to finish the peripheral edge or edge portion of a corrective lens (not shown) disposed in operative relationship relative to the tool operating assembly 10 within a sealed edging or finishing chamber of a cabinet (not shown). The lens shaping machine 12 is capable of forming straight and angle lens edges such as rimless, grooved, square bevel, 'V' bevel, step bevel, facet and polished as well as straight and angled hole/slot configurations such as blind hole, through hole, slot, notch, countersunk or engraving of lens top surface.

As in the previous embodiment, the lens operating assembly comprises a lens support assembly to support the corrective lens (not shown) to be finished and a multi-axis lens positioning assembly to move the corrective lens (not shown) supported on the lens support assembly relative to the tool operating assembly 10 during the finishing operation.

The lens support assembly comprises a lower lens support including a lower lens holder and an upper lens support including an upper lens holder to clamp the corrective lens (not shown) therebetween during the finishing operation similar to the structure depicted in FIG. 6.

As in the first embodiment of the present invention, the multi-axis lens positioning assembly comprises a first or vertical positioning subassembly, a second or horizontal positioning subassembly and a third or rotational positioning subassembly to move the lens support assembly and corrective lens (not shown) vertically, horizontally and rotationally respectively relative to the tool operating assembly 10 during the finishing operation.

The alternate embodiment of the tool operating assembly 10 comprises a multi-station tool support assembly generally indicated as 28 to selectively position one of a plurality of tools each indicated as 30 at a finishing station or location generally indicated as 32 adjacent the lens operating assembly to engage the peripheral edge or edge portion of the corrective lens (not shown) to be finished, a tool drive assembly generally indicated as 34 to rotate the selected tool 30 positioned at the finishing station or location 32 during the finishing operation and a clutch assembly generally indicated as 36 to operatively couple the selected tool 30 and the tool drive assembly 34 to rotate the selected tool 30 during the finishing operation.

The multi-station tool support assembly 28 comprises a turret or turn-table 38 having a plurality of tool assemblies each generally indicated as 40 rotatably mounted thereto coupled to a step motor (not shown) by a gear assembly generally indicated as 42 to selectively position one of the tools 30 at the finishing position or station 32.

As with the first embodiment of the present invention, each tool assembly 40 comprises a tool holder 48 including a tool recess formed in the lower portion thereof to couple a tool 30 thereto. A second or lower magnetic drive or clutch element generally indicated as 52 comprising a rotatable magnetic disk and a first pulley combination generally indicated as 51 extending above the turret or turn-table 38 and coupled to the upper portion of the corresponding tool holder 48 by a second pulley 53 affixed thereto and a corresponding drive belt 55 extending between the rotatable magnetic disk and first pulley combination 51 and the second pulley 53. A first or upper magnetic drive or clutch element 54 (FIG. 12) is located or positioned at the finishing station 32 to cooperatively form a portion of the clutch assembly 36 to rotate the selected tool 30 to finish the peripheral edge or edge portion of the corrective lens (not shown) as described hereinafter.

The diameter of at least two of the pulleys 53 of the second or lower magnetic drive or clutch elements 51 may be different to cause the corresponding tools 30 and tool assemblies 28 to rotate at different speeds with a constant speed tool drive motor 82 when located at the finishing station 32.

Alternately, the tooth count of the pulleys 53 for at least two of the tool assemblies 40 may be different to rotate the corresponding tools 30 at different speeds with a constant speed tool drive motor 82 when located at the finishing station 32.

The multi-station tool support assembly 28 further includes a turret lock corresponding to each tool assembly 40. Specifically, a lock receiver 56 such as a tapered recess is formed in the turret or turn-table 38 adjacent each tool assembly 40 to cooperate with a turret or turn-table locking assembly generally indicated as 58 operable in a locked position and an unlocked position to lock the turret or turn-table 38 against rotation when in the locked position and the appropriate or selected tool 30 and tool assembly 40 are positioned or located at the finishing station 32. The turret or turn-table locking assembly 58 comprises a lock cylinder 60 and a lock piston 62 combination coupled to a pressurized air source (not shown) to selectively move the piston 62 up and down to move a tapered locking pin 64 into the appropriate lock receiver 56 opposite the finishing station 32 when the appropriate tool 30, tool assembly 40 and lower clutch element 52 are aligned with the finishing station 32 when the locked or down position. The turret or turn-table locking assembly 58 further includes a manual positioning device comprising a finger knob 66 extending through a substantially vertical slot 68 attached to or engaged with the lock piston 62.

In addition, a tool position sensing device corresponding to each tool assembly 40 may be positioned on the turret or turn-table 38 each having a discrete identifier to cooperate with a tool assembly position sensing device 72 to indicate the rotational position of the turret or turn-table 38 and the tool assemblies 40 relative to the finishing station 32 to assure the selected tool 30 is positioned or located at the finishing station 32.

Alternatively, the position of the tool assemblies 40 relative to the finishing station 32 may be determined using a single device and discrete identifier to locate a specific designated tool assembly 40 using an encoder to determine the location of the other tool assemblies 40.

The tool drive assembly 34 comprises a substantially vertical tool drive shaft 74 disposed in vertical alignment relative to the finishing station 32 having the first or upper magnetic drive or clutch element 54 coupled to the lower position thereof and movable between an upper position and a lower position by a clutch positioning device. Upper magnetic drive or clutch element 54 is magnetically coupled with the lower magnetic drive or clutch element 52 of the tool assembly 40 located at the finishing station 32 when the substantially vertical tool drive shaft 74 is in the lower position. The substantially vertical tool drive shaft 74 is coupled to the output shaft 80 of a tool drive motor generally indicated as 82 by a drive linkage generally indicated as 84 such as a drive belt.

The clutch positioning device 76 comprises a pneumatic clutch cylinder 86 to operatively house a piston (not shown) coupled to the substantially vertical tool drive shaft 74 to move the tool drive shaft 74 and the upper magnetic drive or clutch element 54 into and out of magnetic coupling with the rotatable magnetic disk of the lower magnetic drive or clutch element 52 by feeding air to one side or the other of the piston (not shown) through air ports 88 and 90 to selectively drive the tool 26 of the tool assembly 40 located at the finishing station 32.

Since the turret or turn-table 38 is driven or rotated by a step motor (not shown), the turret or turn-table 38 is incrementally advanced from one tool assembly 40 to the next tool assembly 40 until the selected tool 30 is sensed by the tool sensing device 70 and tool assembly position sensing device 72 as located at the finishing station 32 vertically aligning the first or lower magnetic drive or clutch element 52 with the upper drive or clutch element 54.

Alternatively, the position of the tool assemblies 40 relative to the finishing station 32 may be determined using a single device and discrete identifier to locate a specific designated tool assembly 40 using an encoder to determine the location of the other tool assemblies 40.

The turret or turn-table 38 is then locked in place the turret or turn-table locking assembly 58. Finally, the clutch assembly is engaged and the tool drive motor 82 and the drive linkage 84 rotate the tool drive shaft 74 to rotate the selected tool assembly 40 and tool 30.

The tool drive motor 82 may be a variable speed motor to drive tools 30 and tool assemblies 40 at different speeds when located at the finishing station 32.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A tool operating assembly for a lens shaping machine to finish the peripheral edge of a corrective lens wherein said tool operating assembly is disposed in operative relationship relative to a lens operating assembly, the lens operating assembly comprising a lens support assembly to support the lens to be finished and a multi-axis lens positioning assembly to move a corrective lens relative to said tool operating assembly during the finishing operation to finish the peripheral edge of the corrective lens, said tool operating assembly comprises a multi-station tool support assembly including a turn-table to operatively support a plurality of tool assemblies each including a tool mounted thereon, said multi-station tool support assembly is rotatably coupled to a motor to selectively position one of said plurality of tool assembles at a finishing station adjacent the lens operating assembly to engage the peripheral edge or edge portion of the lens to be finished, a tool drive assembly comprising a substantially vertical tool drive shaft is disposed in vertical alignment relative to said finishing station and coupled to a tool drive motor, and a magnetically coupled clutch assembly to operatively couple said selected tool assembly and said tool drive assembly to rotate said selected tool assembly positioned at said finishing station during said finishing operation.

2. The tool operating assembly of claim 1 wherein said magnetically coupled clutch assembly comprises an upper magnetic drive or clutch element affixed to said substantially vertical tool drive shaft and a lower drive or clutch element affixed to a portion of each said tool assembly such that said tool assembly disposed in vertical alignment with said substantially vertical drive shaft at said finishing station is magnetically coupled thereto whereby rotation of said substantially vertical tool drive shaft by said tool drive motor rotates said tool of said tool assembly aligned with said substantially vertical drive shaft.

3. The tool operating assembly of claim 2 wherein said upper magnetic drive or clutch element comprises a magnetic disk and said lower drive or clutch element comprises a metal disk.

4. The tool operating assembly of claim 3 wherein said magnetic disk is movable between an upper position and a lower position by a clutch positioning drive to vary the magnetic attraction between said magnetic disk and said metal disk of said tool assembly operatively aligned with said finishing station.

5. The tool operating assembly of claim 2 wherein said upper magnetic disk or clutch element is movable between an upper position and a lower position by a clutch positioning drive to vary the magnetic attraction between said upper magnetic drive or clutch element and said lower drive or clutch element of said tool assembly operatively aligned with said finishing station.

6. The tool operating assembly of claim 2 wherein said tool drive motor is a variable speed motor to selectively drive at least one of said tool assemblies at a different speeds.

7. The tool operating assembly of claim 2 wherein said tool drive motor is a variable speed motor such that at least two of said tool assemblies rotate said corresponding tools at different speeds.

8. The tool operating assembly of claim 1 wherein said magnetically coupled clutch assembly comprises an upper magnetic drive or clutch element affixed to said substantially vertical tool drive shaft and a lower drive or clutch element coupled to a portion of each said tool assembly such that said tool assembly disposed in vertical alignment with said substantially vertical drive shaft at said finishing station is magnetically coupled to said upper magnetic drive or clutch element whereby rotation of said substantially vertical tool drive shaft by said tool drive motor rotates said tool of said tool assembly aligned with said substantially vertical drive shaft.

9. The tool operating assembly of claim 8 wherein said upper magnetic drive or clutch element comprises a magnetic disk and said lower drive clutch element of each said tool assembly comprises a metal disk and a first drive pulley rotatably mounted on said turn-table and coupled to a corresponding tool assembly by a first follower pulley coupled to each said tool assembly by a corresponding drive belt extending between each said first drive pulley and corresponding said first follower pulley.

10. The tool operating assembly of claim 9 wherein said first drive pulley comprises a first plurality of drive teeth including a first drive tooth count and said first follower pulley comprises a first plurality of follower teeth including a first follower tooth count, said first plurality of drive teeth and said first plurality of follower teeth each engaging a plurality of teeth formed on said drive belt to rotate said first follower pulley of said tool assembly aligned with said finishing station.

11. The tool operating assembly of claim 10 wherein said first drive pulley is removably mounted on a spindle such that a second drive pulley including a second drive tooth count replaces said first drive pulley and said first follower pulley is removably mounted on a spindle such that a second follower pulley replaces said first follower pulley whereby the speed of rotation of said tool assembly and said tool at said finishing station is changed.

12. The tool operating assembly of claim 11 wherein the combined tooth count of said first plurality of drive teeth and said first plurality of follower teeth is equal to the combined tooth count of said second plurality of drive teeth and said second plurality of follower teeth.

13. The tool operating assembly of claim 9 wherein the diameter of at least one of said first follower pulleys is different from the diameter of another of said first follower pulleys such that the rotation of said corresponding tool assemblies and tools are different.

14. The tool operating assembly of claim 8 wherein said upper magnetic drive or clutch element is movable between an upper position and a lower position by a clutch positioning drive to vary the magnetic attraction between said upper magnetic drive or clutch element and said lower drive or clutch element of said tool assembly operatively aligned with said finishing station.

15. The tool operating assembly of claim 8 wherein said tool drive motor is a variable speed motor to selectively drive at least one of said tool assemblies at different speeds.

16. The tool operating assembly of claim 8 wherein said tool drive motor is a variable speed motor such that at least two of said tool assemblies to rotate said corresponding tools at different speeds.

* * * * *